US006962122B1

(12) United States Patent
Bouldin, Jr.

(10) Patent No.: US 6,962,122 B1
(45) Date of Patent: Nov. 8, 2005

(54) DOCKING APPARATUS WHICH SECURES A BOAT TO A PIER

(76) Inventor: Alfred Bouldin, Jr., 1926 Wareham Rd., Baltimore, MD (US) 21222

( * ) Notice: Subject to any disclaimer, the term of this patent is extended or adjusted under 35 U.S.C. 154(b) by 0 days.

(21) Appl. No.: 11/039,412

(22) Filed: Jan. 19, 2005

(51) Int. Cl.[7] ..... B63B 21/00
(52) U.S. Cl. ..... 114/230.17
(58) Field of Search ..... 114/230.1, 230.15, 114/230.17

(56) References Cited

U.S. PATENT DOCUMENTS 2,930,339 A * 3/1960 Trnka ..... 114/230.15
4,250,827 A 2/1981 Booker ..... 114/230
4,751,892 A * 6/1988 Sechel et al. ..... 114/221 R
5,361,716 A * 11/1994 Cotton ..... 114/230.11
5,694,879 A 12/1997 Taylor ..... 114/230
6,029,596 A 2/2000 Hoofman ..... 114/230.1
2002/0104470 A1 * 8/2002 Leise ..... 114/230.15

* cited by examiner

*Primary Examiner*—Stephen Avila
(74) *Attorney, Agent, or Firm*—Goldstein Law Office, PC.

(57) ABSTRACT

This invention is a docking apparatus for small boats which secures the boat to a pier without use of ropes and fenders having two dock mounts securely affixed spaced apart to the pier and each having an elongated sleeve. Two docking poles each include a first end and a second end, and each have an extension arm which telescopes outwardly to reach the boat. The first ends are inserted within the elongated sleeve of the two docking mounts the second ends have a spring loaded snap clamp having an insertion opening. A stabilizer bar is secured centrally between the two docking poles. A pair of boat mounting cleats are attached to the boat and each have a hole. The insertion openings of the spring loaded snap clamps attach securely to the holes of the boat mounting cleats.

7 Claims, 4 Drawing Sheets

DOCKING APPARATUS WHICH SECURES A BOAT TO A PIER

BACKGROUND OF THE INVENTION

The invention relates to mooring devices, and more particularly, to a docking apparatus for small boats which secures the boat to a pier without the use of ropes.

Recreational boating is one of America's most popular and rewarding pastimes. Blessed with an abundance of scenic rivers, lakes, streams, and coastal waters, our country is a haven for people who love the water. Americans take to the water each year with family and friends to appreciate nature, relax, and simply escape from the cares of the day. The increased popularity of other water sports, such as water-skiing and scuba diving, has also stimulated interest in boating.

Docking a boat can be a time consuming and challenging task, when done properly, which entails securing the boat to cleats with ropes and hanging fenders over the sides to prevent the boat from banging against the pilings. Many skippers will readily admit to feeling uneasy about docking boats, especially in adverse conditions.

U.S. Pat. No. 6,029,596 to Hoofmann discloses a means for securing a watercraft to a mooring using a leg element attached to a boom assembly to prevent vertical or horizontal movement. U.S. Pat. No. 4,250,827 to Booker discloses a boat mooring comprised of a base having extendable telescoping arms with a hook. U.S. Pat. No. 5,694,879 to Taylor discloses a mooring device comprised of an elongated tubular housing with a helical spring incorporated.

While these units may be suitable for the particular purpose employed, or for general use, they would not be as suitable for the purposes of the present invention as disclosed hereafter.

SUMMARY OF THE INVENTION

It is an object of the invention to produce a means for small boats which secures the boat to a pier without use of ropes and fenders. Accordingly, the invention is a docking apparatus having two docking poles which extend outwardly from a dock and secure to the boat without the use of ropes and fenders.

It is another object of the invention to provide a means for securing a boat at a pier from horizontal and vertical movement. Accordingly, the two docking poles of the invention prevent the boat from moving horizontally and slamming into the pier. The invention also includes a stabilizer bar connecting the two docking poles which prevents the boat from moving vertically forward and backward.

It is another object of the invention to provide an easy means of securely attaching the docking apparatus to the boat. Accordingly, the two docking poles each have a spring loaded snap clamp having an insertion opening and a pair of boat mounting cleats are attached to the boat and each have a hole. The insertion openings of the spring loaded snap clamps easily attach to the holes of the boat mounting cleats.

This invention is a docking apparatus for small boats which secures the boat to a pier without use of ropes and fenders having two dock mounts securely affixed spaced apart to the pier and each having an elongated sleeve. Two docking poles each include a first end and a second end, and each have an extension arm which telescopes outwardly to reach the boat. The first ends are inserted within the elongated sleeve of the two docking mounts the second ends have a spring loaded snap clamp having an insertion opening. A stabilizer bar is secured centrally between the two docking poles. A pair of boat mounting cleats are attached to the boat and each have a hole. The insertion openings of the spring loaded snap clamps attach securely to the holes of the boat mounting cleats.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
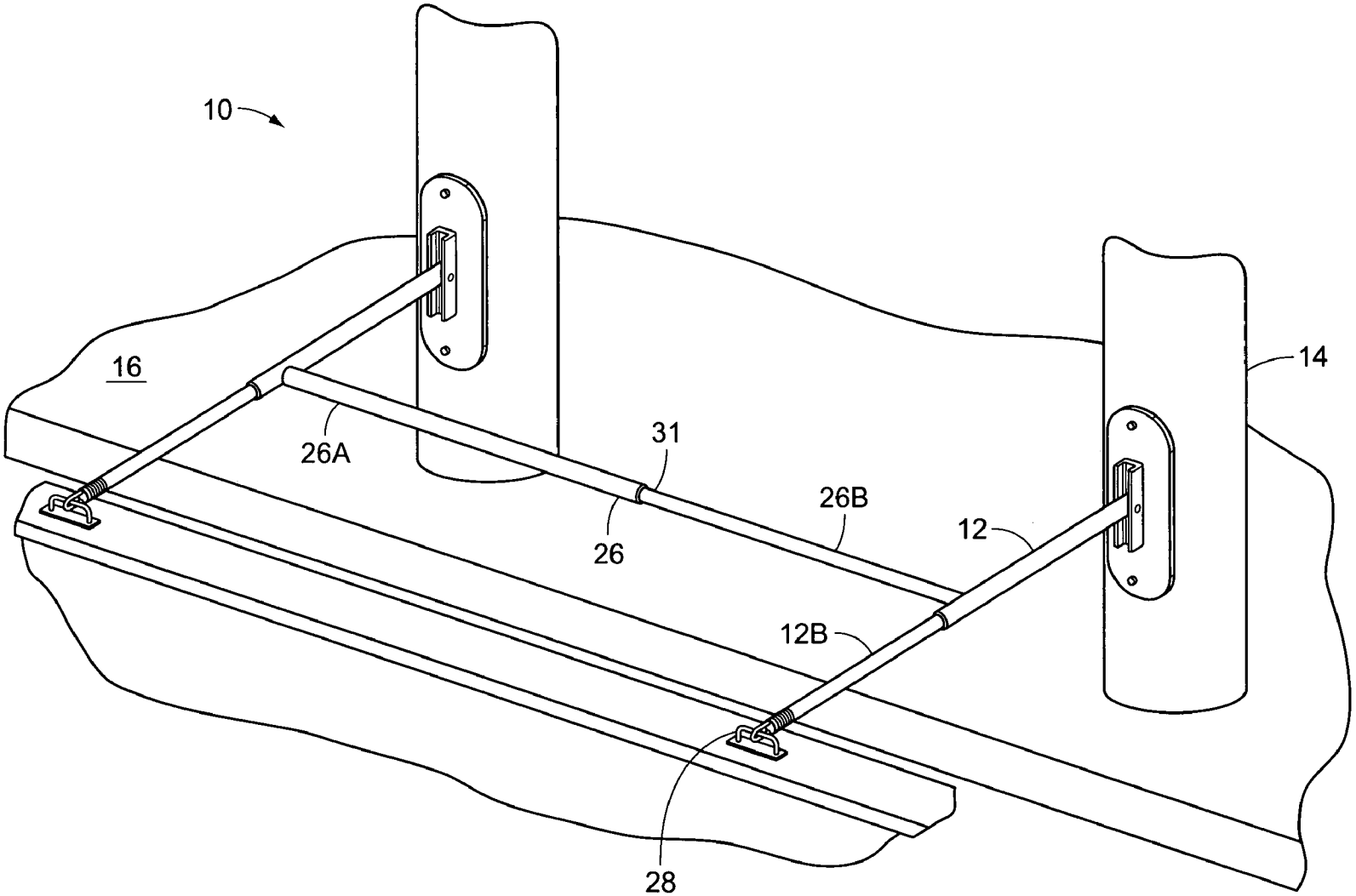
FIG. 1 is a diagrammatic perspective view of the docking apparatus of the present invention having two docking poles which extend outwardly from a dock and secure to the boat without the use of ropes and fenders.

FIG. 1 illustrates a docking apparatus 10 of the present invention for small boats which secures the boat to a pier without use of ropes and fenders. Preferably, the docking apparatus 10 is made of plastic, like fiberglass, and metal materials, and is used by boats, having an edge, ranging in size from sixteen feet in length to thirty feet in length.

Figure 2:
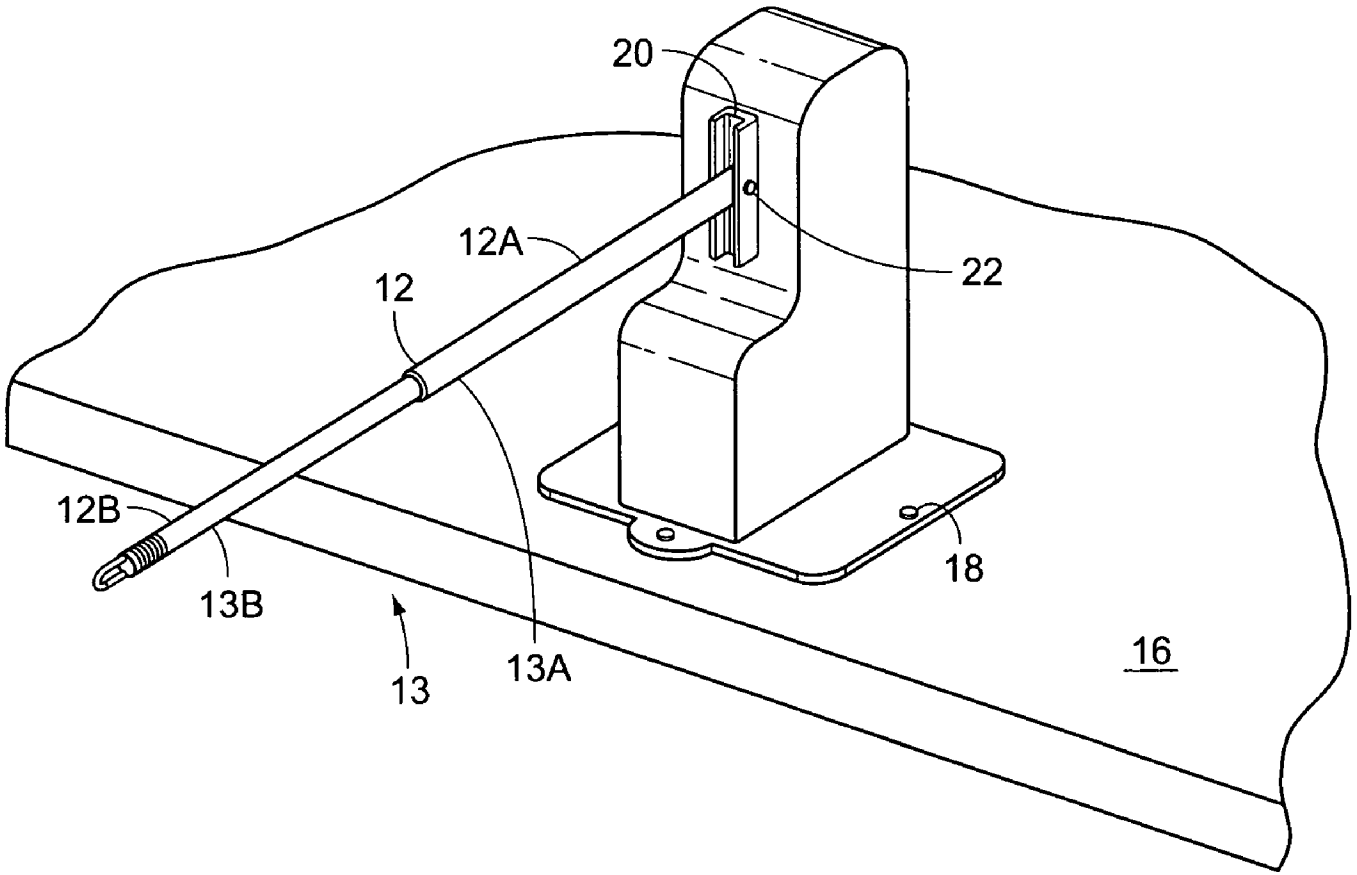
FIG. 2 is a diagrammatic perspective view of the docking apparatus of the present invention having two dock mounts securely affixed spaced apart to the pier and each having an elongated sleeve.
Figure 4:
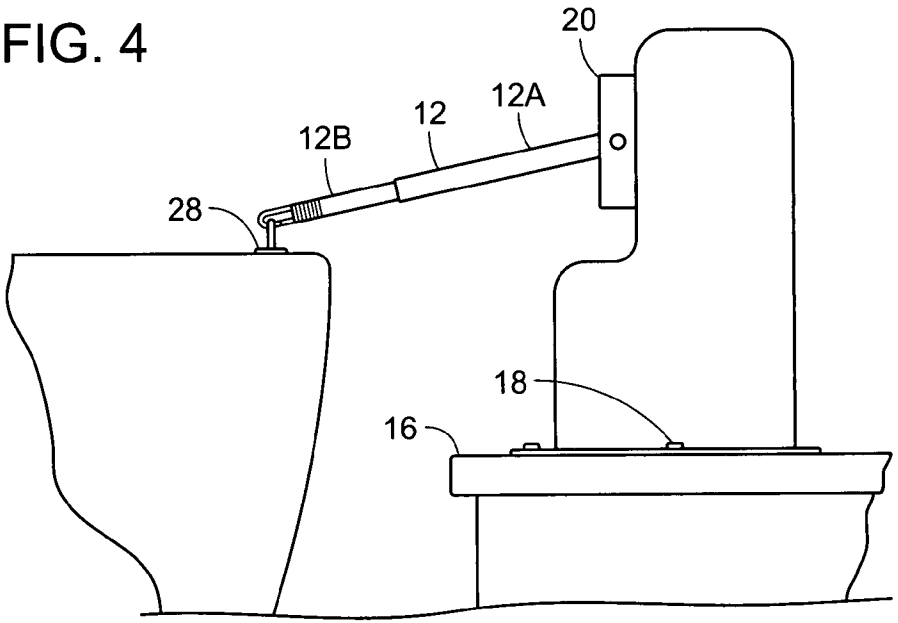
FIG. 4 is a diagrammatic perspective view of the docking apparatus of the present invention wherein the docking poles have a horizontal position along the dock mounts when in use.
Figure 3:
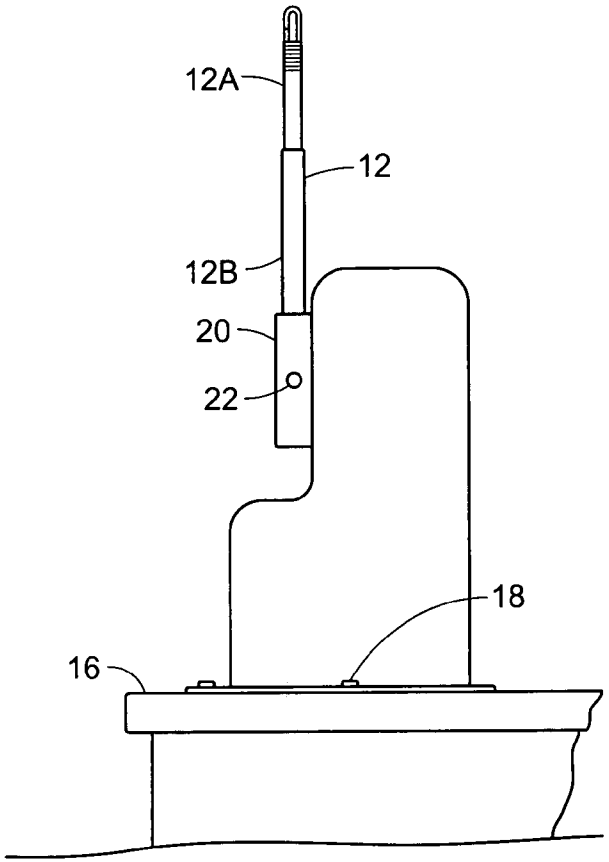
FIG. 3 is a diagrammatic perspective view of the docking apparatus of the present invention wherein the docking poles have a vertical position along the dock mounts when not in use.

The docking apparatus 10 includes two docking poles 12 and two dock mounts 14. Referring to FIG. 2, the dock mounts 14 are substantially rectangular in shape and are securely affixed spaced apart to a pier or dock 16 by a plurality of bolts 18. Preferably, by four bolts 18. The dock mounts 14 include an elongated sleeve 20. The two docking poles 12 each include a first end 12A and a second end 12B. The two docking poles 12 each have an extension arm 13 including a first extension arm 13A and a second extension arm 13B which telescope outwardly to reach the boat. The first ends 12A of the docking poles 12 are inserted within the elongated sleeve 20 and held in place with a pin 22. The first ends 12A are rotatable about the pin 22, such that the docking poles 12 assume a vertical position along the dock mounts 14 when not in use, shown in FIG. 3, and a horizontal position along the dock mounts 14 when in use as shown in FIG. 4.

Figure 5:
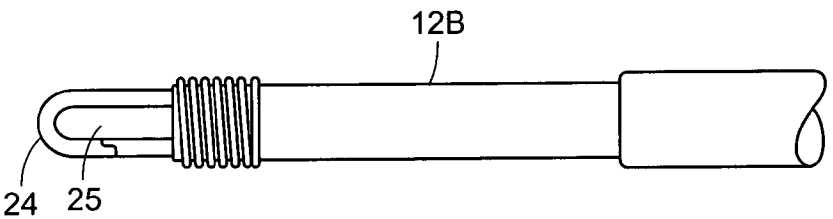
FIG. 5 is a diagrammatic perspective view of the docking apparatus of the present invention wherein the docking poles each have a spring loaded snap clamp having an insertion opening, which easily rotates upwardly and downwardly.

Referring to FIG. 5, the second ends 12B of the docking poles 12 each include spring loaded snap clamps 24 having an insertion opening 25, which easily rotates upwardly and downwardly.

In FIG. 1, a stabilizer bar 26 is secured centrally between the two docking poles 12. The stabilizer bar 26 prevents the boat from moving vertically forward and backward, while the two docking poles 12 prevent the boat from moving horizontally and slamming into the pier. The stabilizer bar 26 includes a first and a second section 26A and 26B. The stabilizer bar 26 is adjustable by a compression spring 31 between the first and second sections 26A and 26B for allowing the stabilizer bar 26 to span a desired length.

Figure 6:
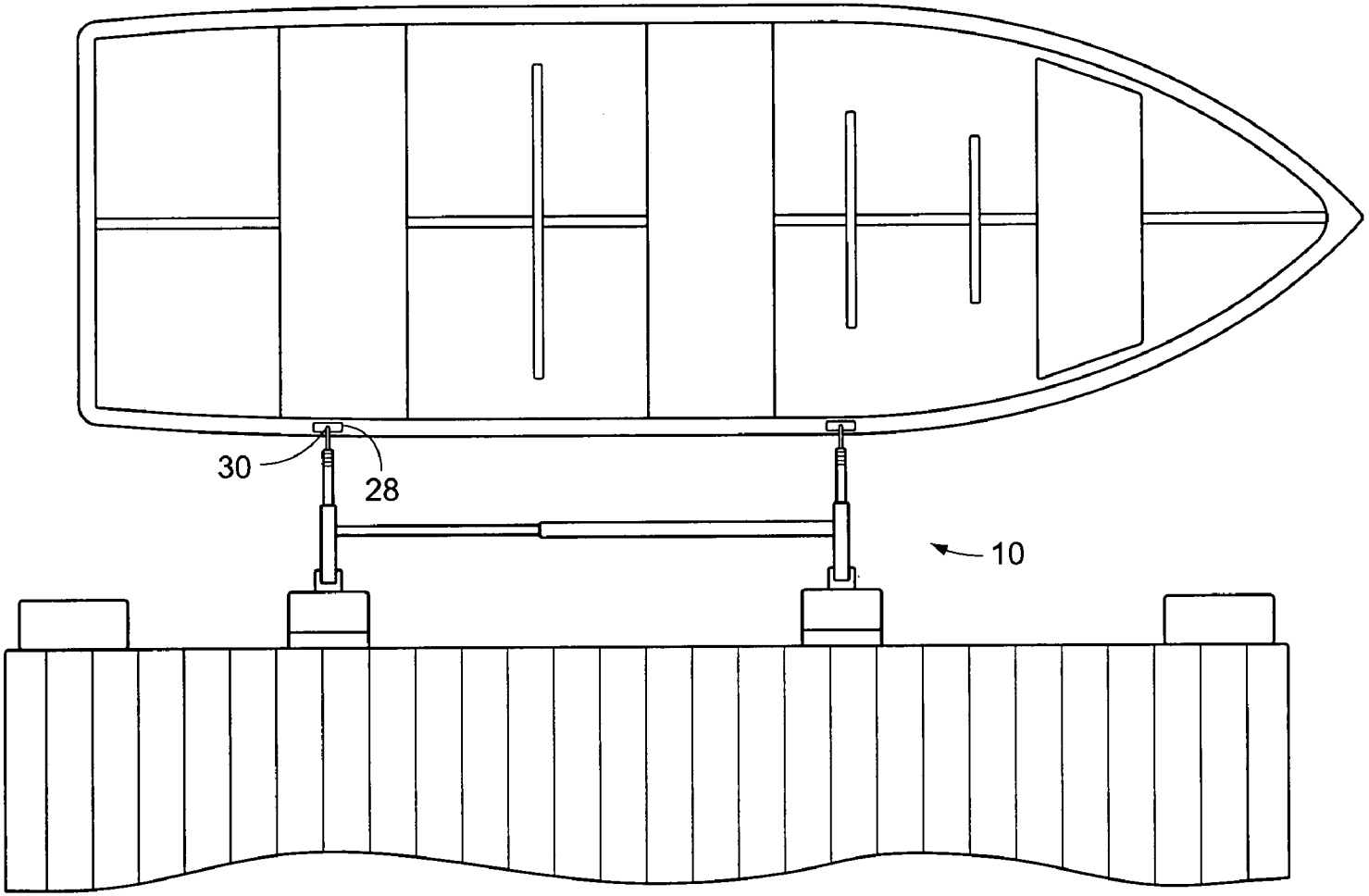
FIG. 6 is a diagrammatic perspective view of the docking apparatus of the present invention having a pair of boat mounting cleats attached to the boat near the edge corresponding to the spacing of the two docking poles for securely attaching through the insertion openings of the spring loaded snap clamps.

FIG. 6 illustrates a pair of boat mounting cleats 28 spaced apart and attached to the boat near the edge corresponding to the spacing of the two docking poles 12. The boat mounting cleats 28 each include a hole 30 therethrough. The insertion openings 25 of the spring loaded snap clamps 24 attach securely to the holes 30 of the boat mounting cleats 28 as shown in FIG. 1.

In use, a boater slowly maneuvers the boat parallel to the pier or dock 16 for mooring. The use grabs the second ends 12B of each one of the docking poles 12 and attaches the spring loaded snap clamps 24 securely to the holes 30 of the boat mounting cleats 28.

In conclusion, herein is presented a docking apparatus. The invention is illustrated by example in the drawing figures, and throughout the written description. It should be understood that numerous variations are possible, while adhering to the inventive concept. Such variations are contemplated as being a part of the present invention.

What is claimed is:

1. A docking apparatus for small boats which secures the boat to a pier without use of ropes and fenders, the boat having an edge, comprising:

a two dock mounts each having an elongated sleeve, said dock mounts being substantially rectangular in shape and securely affixed spaced apart to the pier by a plurality of bolts;

a two docking poles each include a first end and a second end, and each having an extension arm including a first extension arm and a second extension arm which telescope outwardly to reach the boat, the first ends being inserted within the elongated sleeve of the two docking mounts and held in place with a pin, the first ends being rotatable about the pin such that the docking poles assume a vertical position along the dock mounts when not in use and a horizontal position along the dock mounts when in use, the second ends including spring loaded snap clamps having an insertion opening for easily rotating upwardly and downwardly for preventing the boat from moving horizontally and slamming into the pier;

a stabilizer bar being secured centrally between the two docking poles having a first and a second section adjustable by a compression spring between said first and second sections for preventing the boat from moving vertically forward and backward; and a pair of boat mounting cleats spaced apart and attached to the boat near the edge corresponding to the spacing of the two docking poles, each having a hole therethrough, the insertion openings of the spring loaded snap clamps attach securely to the holes of the boat mounting cleats.

2. A docking apparatus for small boats which secures the boat to a pier without use of ropes and fenders, the boat having an edge, comprising:

a two dock mounts each having an elongated sleeve, said dock mounts being substantially rectangular in shape and securely affixed spaced apart to the pier by a plurality of bolts;

a two docking poles each include a first end and a second end, and each having an extension arm including a first extension arm and a second extension arm which telescope outwardly to reach the boat, the first ends being inserted within the elongated sleeve of the two docking mounts, the second ends including spring loaded snap clamps having an insertion opening;

a stabilizer bar being secured centrally between the two docking poles having a first and a second section adjustable by a compression spring between said first and second sections; and a pair of boat mounting cleats spaced apart and attached to the boat near the edge corresponding to the spacing of the two docking poles, each having a hole therethrough.

3. The docking apparatus of claim 1, wherein a pin holds the first ends of the two docking poles within the elongated sleeves of the two docking mounts.

4. The docking apparatus of claim 3, wherein the first ends are rotatable about the pin such that the docking poles assume a vertical position along the dock mount when not in use and a horizontal position along the dock mount when in use.

5. The docking apparatus of claim 4, wherein the stabilizer bar prevents the boat from moving vertically forward and backward.

6. The docking apparatus of claim 5, wherein the insertion opening easily rotates upwardly and downwardly for preventing the boat from moving horizontally and slamming into the pier.

7. The docking apparatus of claim 6, wherein the insertion openings of the spring loaded snap clamps attach securely to the holes of the boat mounting cleats.

* * * * *